US006931143B2

(12) United States Patent
Caron et al.

(10) Patent No.: US 6,931,143 B2
(45) Date of Patent: Aug. 16, 2005

(54) THIN ENCLOSURE ELECTROACOUSTICAL TRANSDUCING

(75) Inventors: Gerald F. Caron, Andover, MA (US); Jeffrey Hoefler, Randolph, MA (US); Christopher B. Ickler, Sudbury, MA (US); Roberto M. Dizon, Cambridge, MA (US)

(73) Assignee: Bose Corporation, Framingham, MA (US)

( * ) Notice: Subject to any disclaimer, the term of this patent is extended or adjusted under 35 U.S.C. 154(b) by 97 days.

(21) Appl. No.: 10/208,135

(22) Filed: Jul. 30, 2002

(65) Prior Publication Data

US 2004/0022405 A1 Feb. 5, 2004

(51) Int. Cl.[7] ..... H04R 1/02

(52) U.S. Cl. ..... 381/337; 381/350; 381/386; 181/184; 181/189

(58) Field of Search ..... 381/337, 345, 381/350, 352, 386, 74, 370, 371; 181/179, 184, 185, 186, 189, 198, 199, 288, 293

(56) References Cited

U.S. PATENT DOCUMENTS

| | | | | | |
|---|---|---|---|---|---|
| 1,953,523 | A | * | 4/1934 | Wolff | 381/351 |
| 3,716,671 | A | * | 2/1973 | Karr | 381/395 |
| 5,805,708 | A | * | 9/1998 | Freadman | 381/345 |
| 5,929,393 | A | * | 7/1999 | Jeter, Jr. | 181/199 |
| 6,597,792 | B1 | * | 7/2003 | Sapiejewski et al. | 381/71.6 |

* cited by examiner

*Primary Examiner*—Curtis Kuntz
*Assistant Examiner*—Brian Ensey
(74) *Attorney, Agent, or Firm*—Fish & Richardson P.C.

(57) ABSTRACT

An electroacoustical transducer has an enclosure having a thickness substantially smaller than the width and the depth. The transducer includes a first rigid sheet, a second rigid sheet, and a spacing structure for spacing the first rigid sheet from the second rigid sheet to define an acoustic enclosure, having a top, a bottom and a side edge. The top includes the first rigid sheet and the bottom includes the second rigid sheet. The transducer includes an acoustic transducer for exchanging sound waves with the acoustic enclosure. The enclosure has a plurality of outlet points.

37 Claims, 10 Drawing Sheets

THIN ENCLOSURE ELECTROACOUSTICAL TRANSDUCING

BACKGROUND OF THE INVENTION

The invention relates to electroacoustical transducing, and more particularly to electroacoustical transducing with thin enclosures.

It is an important object of the invention to provide electroacoustical transducing with a form factor.

It is a further object of the invention to provide an enclosure that can be incorporated in elements such as a deskpad, wall, ceiling, or floor.

It is still a further object of the invention to provide equal total direct acoustic path lengths from an electroacoustical transducer to a predetermined point in space.

BRIEF SUMMARY OF THE INVENTION

According to the invention, an electroacoustical transducer includes a first rigid sheet and a second rigid sheet. The transducer further includes a spacing structure for spacing the first rigid sheet from the second rigid sheet to define an acoustic enclosure that has a top, a bottom and a side edge; the top including the first rigid sheet and the bottom including the second rigid sheet. The acoustic enclosure has a thickness that is substantially less than the width and the depth. The transducer also includes an acoustic transducer, mounted so that the sound waves are exchanged with the acoustic enclosure. The sound waves exchanged with the acoustic transducer pass through outlet points adjacent the environment surrounding the acoustic enclosure. The second rigid sheet may be constructed and arranged to conform to a planar surface.

In another aspect of the invention, a first portion of the plurality of outlet points are points in a first continuous opening in the side edge of the acoustic enclosure, and a second portion of the plurality of outlet points are points in a second continuous opening in the side edge of the acoustic enclosure. In one embodiment, each of the first plurality of outlet points has an associated total direct acoustic path length consisting of an effective internal acoustic length in the acoustic enclosure between the acoustic transducer and the outlet point and an external acoustic length between each outlet point and a first predetermined region in space. The electroacoustic transducer is constructed and arranged so that the total direct acoustic path lengths associated with the first plurality of outlet points are substantially equal. The transducer also has a second acoustic transducer that exchanges sound waves with the acoustic enclosure. There is a second plurality of outlet points in the enclosure, so that the second sound waves exchanged with the second acoustic transducer are exchanged through the second plurality of outlet points adjacent the environment surrounding the acoustic enclosure. A first portion of the second plurality of outlet points are points in a third continuous opening in the side edge of the acoustic enclosure. A second portion of the second plurality of outlet points are points in a fourth continuous opening in the side edge of the acoustic enclosure. Each of the second plurality of outlet points has an associated total direct acoustic path length consisting of an effective internal acoustic length in the acoustic enclosure between the acoustic transducer and the outlet point and an external acoustic length between the outlet point and a second predetermined region in space. The loudspeaker is constructed and arranged so that the total direct acoustic path lengths associated with the second plurality of outlet points are substantially equal. The first and second regions in space may coincide.

The outlet points may be in a common plane and may be arranged in an elliptical pattern.

Other features, objects, and advantages will become apparent from the following detailed description, when read in connection with the accompanying drawing in which:

DETAILED DESCRIPTION

Figure 1:
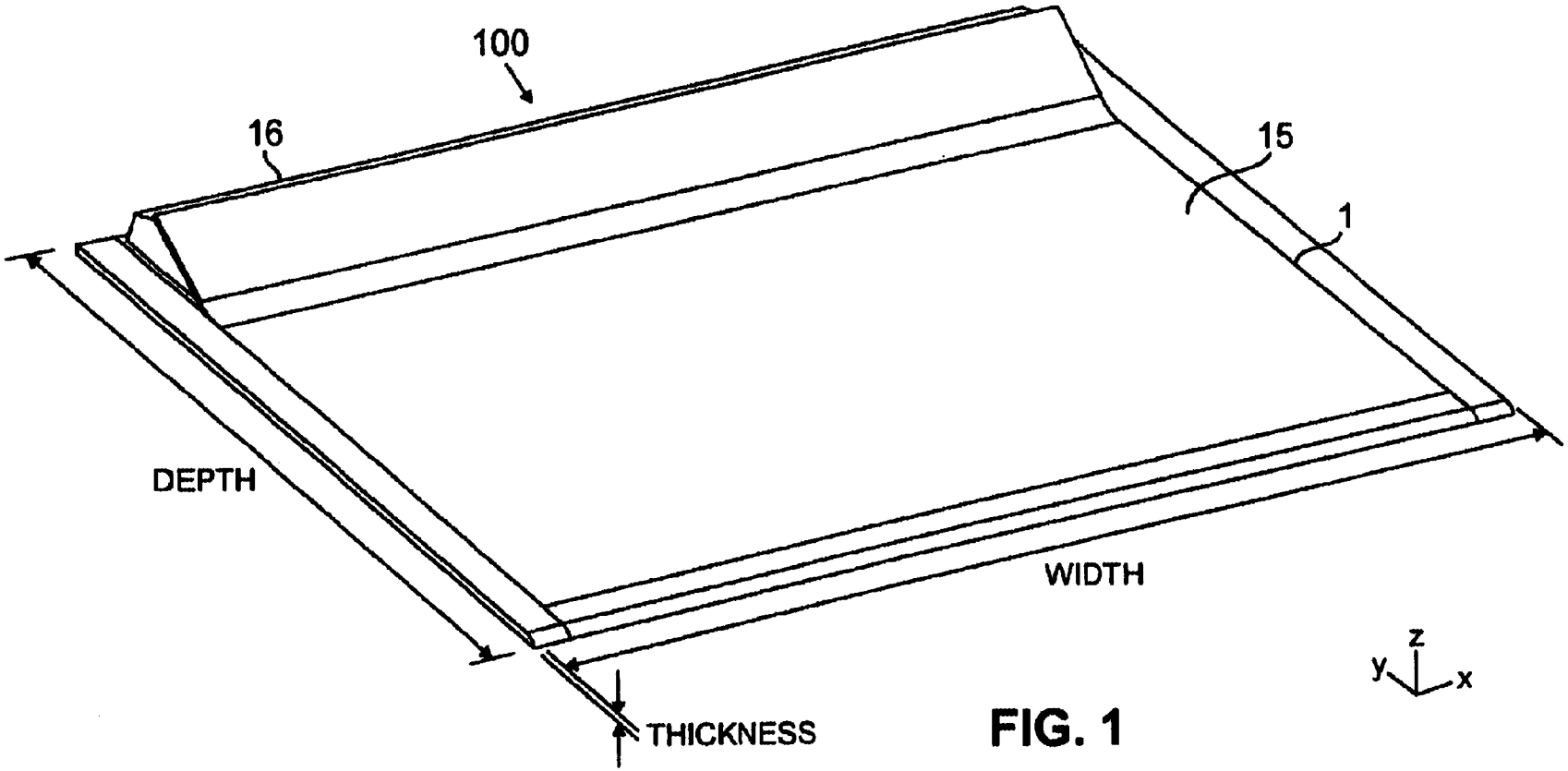
FIG. 1 is an isometric view of a transducer according to the invention.

With reference now to the drawing and more particularly to FIG. 1, there is shown a transducer 100. Acoustic enclosure 1 has a width and a depth that are significantly greater than the thickness. The width, depth, and thickness are dimensioned such that the acoustic enclosure 1 may be used as a deskpad. In one exemplary implementation, the width is about 34 inches (86.36 cm), the depth is about 23 inches (58.42 cm), and thickness is about 0.368 inches (0.935 cm), so that the ratio between the thickness and the shorter of the width and depth (in this case the depth) is about 62.5. Acoustic enclosure 1 has a large area 15 on the upper surface that is smooth and preferably planar, so that it can be used as a deskpad. Large area 15 may be made of, or covered by, a material that provides a good writing surface, and additionally areas of area 15 may have ornamental trim, which could add to the thickness. The term "thickness," as used hereafter, excludes ornamental trim. Acoustic enclosure 1 has a mounting point (not shown in this view) for an acoustic transducer, which may be in a raised region 16. In other embodiments, the dimensions may vary from the exemplary dimensions. Generally, the thickness is less than one inch and is substantially less than both the width and the depth so that the ratio between the thickness and the smaller of the width and the depth is at least 20:1.

Figure 2:
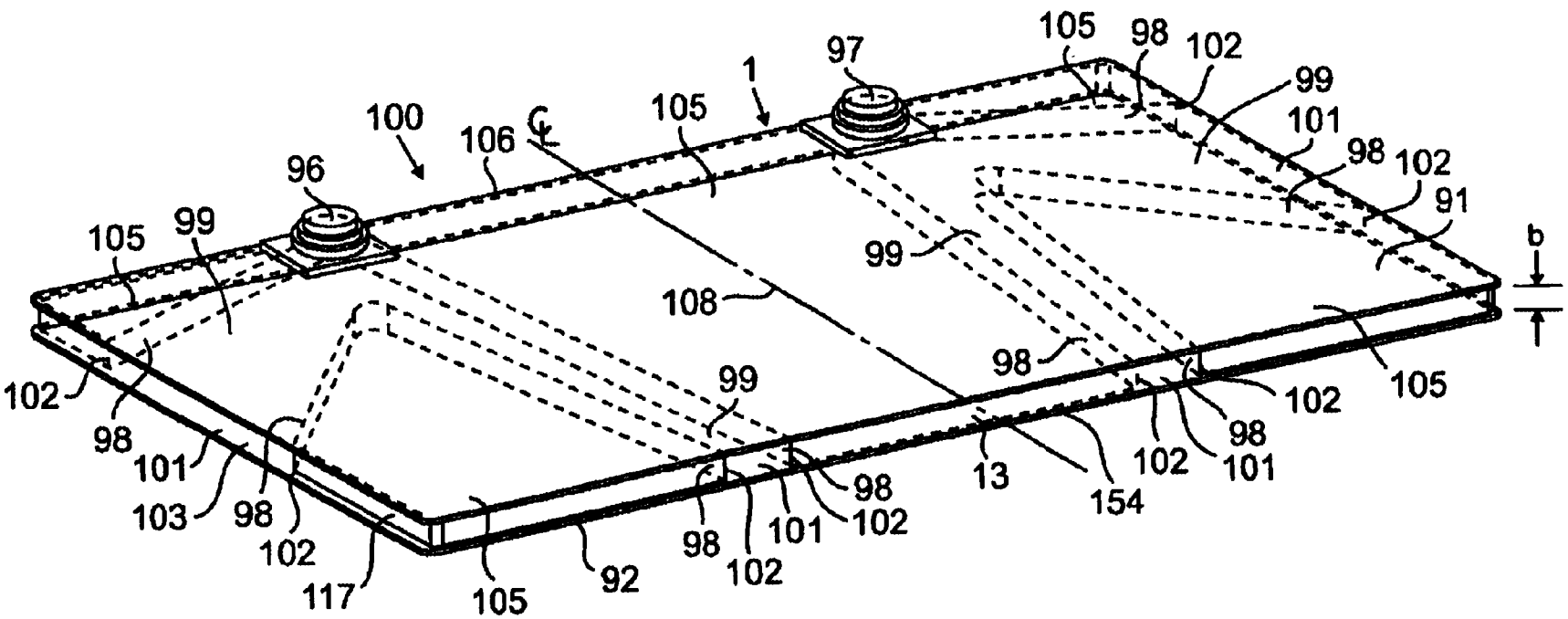
FIG. 2 is the transducer of FIG. 1, showing with an exaggerated vertical dimension, and with the top optically transparent to show internal elements of the transducer.
Figure 3:
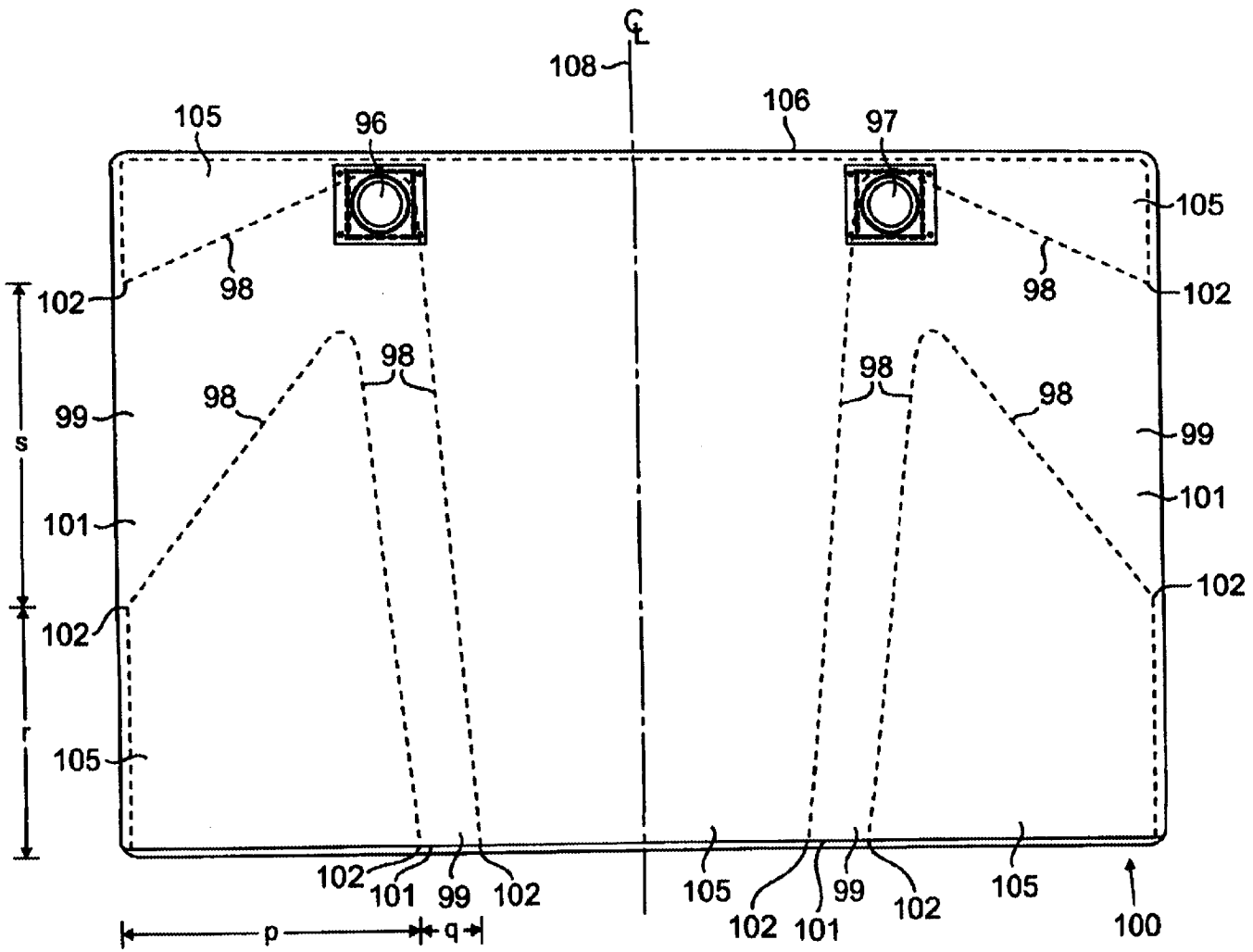
FIG. 3 is a top plan view the loudspeaker of FIG. 1, with the top optically transparent to show internal elements.

Referring now to FIGS. 2 and 3, there is shown the transducer of FIG 1, with the vertical dimension exaggerated to more clearly show features of thereof. Top 91 and bottom 92 are spaced so as to define an interior volume 117 between top 91 and bottom 92. Acoustic transducers 96 and 97 each having a vibratile diaphragm are positioned so that they exchange sound waves with the interior volume 117 with only one side of the diaphram. Baffles 98 define ducts 99 which conduct sound waves between acoustic transducers 96 and 97 and outlet openings 101 in the acoustic enclosure 1. In this embodiment the openings 101 are on the side vertical edge 13 of the acoustic enclosure 1. Baffles 98 may also be used to space the top 91 from the bottom 92.

In one implementation of the embodiment of FIGS. 2 and 3, top 91 and bottom 92 are aluminum sheets about 0.090 inches (2.29 mm) thick, or some other metal or plastic of a thickness so that the sheet is rigid. The height of baffles is about 0.188 inches (4.78 mm). Acoustic transducers 96 and 97 can be conventional narrow, wide, or full range acoustic drivers, such as 35 to 75 mm cone type acoustic drivers, with the specific driver selected based on desired performance, cost, and other factors. Acoustic transducers 96 and 97 are positioned in a closed back structure with a sound wave exchanging surface facing into ducts 99 in the interior of the structure. The acoustic transducers 96 and 97 are centered at a position 1.5 inches (3.81 cm) from the back edge 106 and 8.45 inches (21.46 cm) from centerline 108. Baffles are shaped, dimensioned, and positioned such that there is one opening on the side edge of the structure with a length s of about 11 inches (27.94 cm), and with the distance r from the front 154 of the structure to the closest end of the opening about 7.25 inches (18.42 cm). There is a second opening in the front of the structure; the distance p from the nearest corner of the structure is about 9.5 inches (24.13 cm) and the width of the q of the opening is about 2.0 inches (5.08 cm). Baffles 98 are shaped and positioned such that there are two like openings, placed symmetrically with respect to centerline 108. In one implementation, sheets of a plastic such as ABS or PVC sheet stock, 0.188 inches (4.78 mm) thick, are sandwiched between the top and the bottom. The plastic sheets are shaped and dimensioned so that the edges of the portions of the plastic sheets function as the baffles 98 to define the ducts 99, and so that the plastic sheets function as spacers of the top 91 and bottom 92, and provide structural support for the top 91.

In operation, acoustic transducers 96 and 97 may exchange audio signals with an audio signal source or receiving device (not shown) such as one or more of a radio tuner, CD or DVD player, intercom, or speaker phone. Acoustic transducers 96 and 97 transduce sound waves or audio signals. Sound waves travel through ducts 99 and through outlet openings 101, so that sound may be exchanged in the vicinity of the transducer 100. In the embodiment of FIG. 1 and the other figures, the audio signals transduced by the two acoustic transducers 96 and 97 could be two channels of a stereophonic audio signal. The system could also be implemented with a monaural audio signal, by sending the same signal to both acoustic transducers or to only one of the acoustic transducers. The invention may be used in a speakerphone system to transduce the voice of a speaker at the predetermined location into audio electrical signals transmitted over telephone channels.

If it is desired to extend the range of frequencies lower in the bass range, the implementation of FIGS. 2 and 3 can be supplemented by a bass unit housed in a separate enclosure. The bass unit (not shown) can be placed at any convenient location, such as under a desk, and may comprise a Bose Acoustimass® enclosure.

A transducer 100 according to the invention is advantageous because a single device can be used as both a desk pad and as a transducer. The transducer is housed in a manner such that it uses effectively no desktop space, does not intrude into the environment, cannot be knocked over, and is highly resistant to damage.

Figure 4:
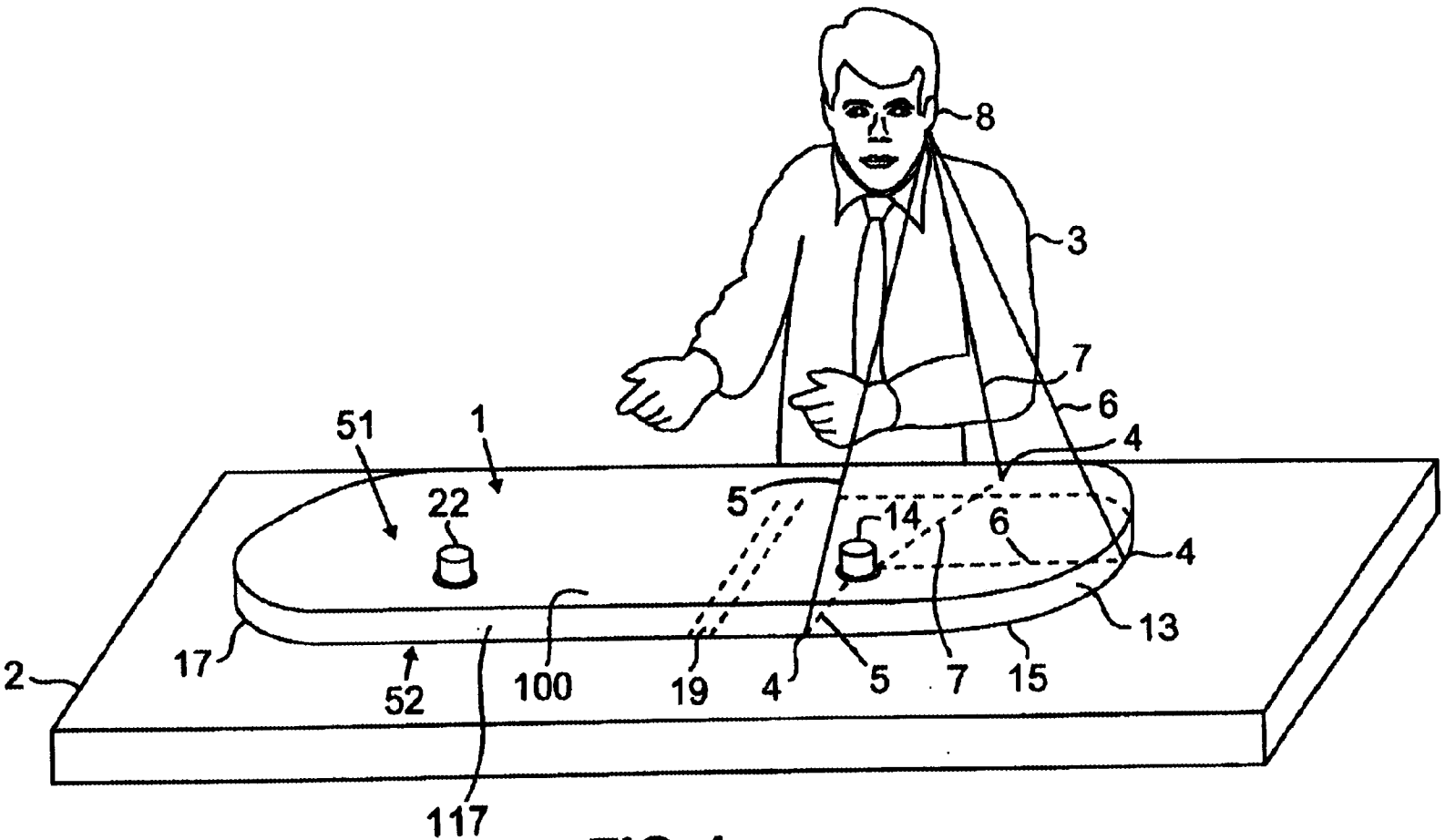
FIG. 4 is an isometric view of a transducer according to the invention, showing the placement of the transducer relative to a user.

Referring now to FIG 4, there is shown an isometric view illustrating another aspect of the invention. A transducer 100 is positioned on a desktop 2. A user 3 is seated near one edge of desktop 2. Transducer 100. is a substantially planar object, with a thickness substantially less than its other dimensions so that it can function as a deskpad. The transducer 100 includes an acoustic enclosure 1, which has a top 51 and may have a bottom 52. If desired, the desktop 2 may be the bottom, or the acoustic enclosure could be built into the desktop. Hereinafter, the system will be described as if the enclosure 1 has a bottom 52. Acoustic enclosure 1 has an interior volume 117 between top 51 and bottom 52 in which are one or more interior sound conducting regions which conduct sound waves. An acoustic transducer 14 is acoustically coupled to the interior sound conducting region. Sound waves are exchanged with the acoustic transducer 14, are conducted through the interior sound conducting region and through outlet points in the acoustic enclosure. In this embodiment, the outlet points are points on a continuous opening on the side edge 13 of acoustic enclosure 1. Placement of the acoustic transducer, shape of the perimeter of top 51, and the configuration and dimension of the interior sound conducting region are constructed and arranged so that the length of the total direct acoustic path (defined as the path from the acoustic transducer 14 to the outlet point 4 to a predetermined region in space, such as the nearest ear of the user 3, for example paths 5, 6, and 7) for as many of the outlet points as practical are substantially equal. Examples of acoustic transducer placement, shape of top 51 and configuration and dimension of the interior sound conducting region that result in equal total direct acoustic paths, such as 5, 6, and 7, are described below. In FIG 4, the features of the left (relative to user 3) side 15 of the acoustic enclosure are shown; there may be a mirror image arrangement on the second (in this example, the user's right) side 17 with a baffle 19 separating the interior portions of the two sides. In this view, only the second acoustic transducer 22 of the arrangement on second side 17 is shown.

In operation, sound exchanged with acoustic driver 14 travels through the interior sound conducting section along the several paths of which acoustic paths 5, 6, and 7 are examples. Since the several total direct acoustic path lengths from the acoustic transducer to the user's nearest ear are substantially equal, sound radiated by acoustic transducer 14 tends to sum coherently at the user's ear, and to sum less coherently elsewhere. Additionally, the sound radiated by a single acoustic transducer, such as transducer 14 can be radiated from multiple points in space. The points may be along a continuous opening, as in FIGS. 4, 5, and 6*a* or may be points along separate continuous openings, as in FIGS. 2, 3, and 9 (below), or may be discrete openings, as in FIGS. 6*b* and 8 (below).

In some implementations, especially those not requiring demanding spatial effects, such as voice, the total direct acoustic paths for both acoustic transducers may be calculated so that the predetermined region in space for the two acoustic transducers is coincident, such a the midpoint between the user's ears, or the user's mouth.

A loudspeaker embodiment according to the invention is advantageous because the coherent summing at the user's ears and the radiation from a single acoustic driver from multiple regions in space can result in an enhanced spatial effect at the user's ears.

Figure 5:
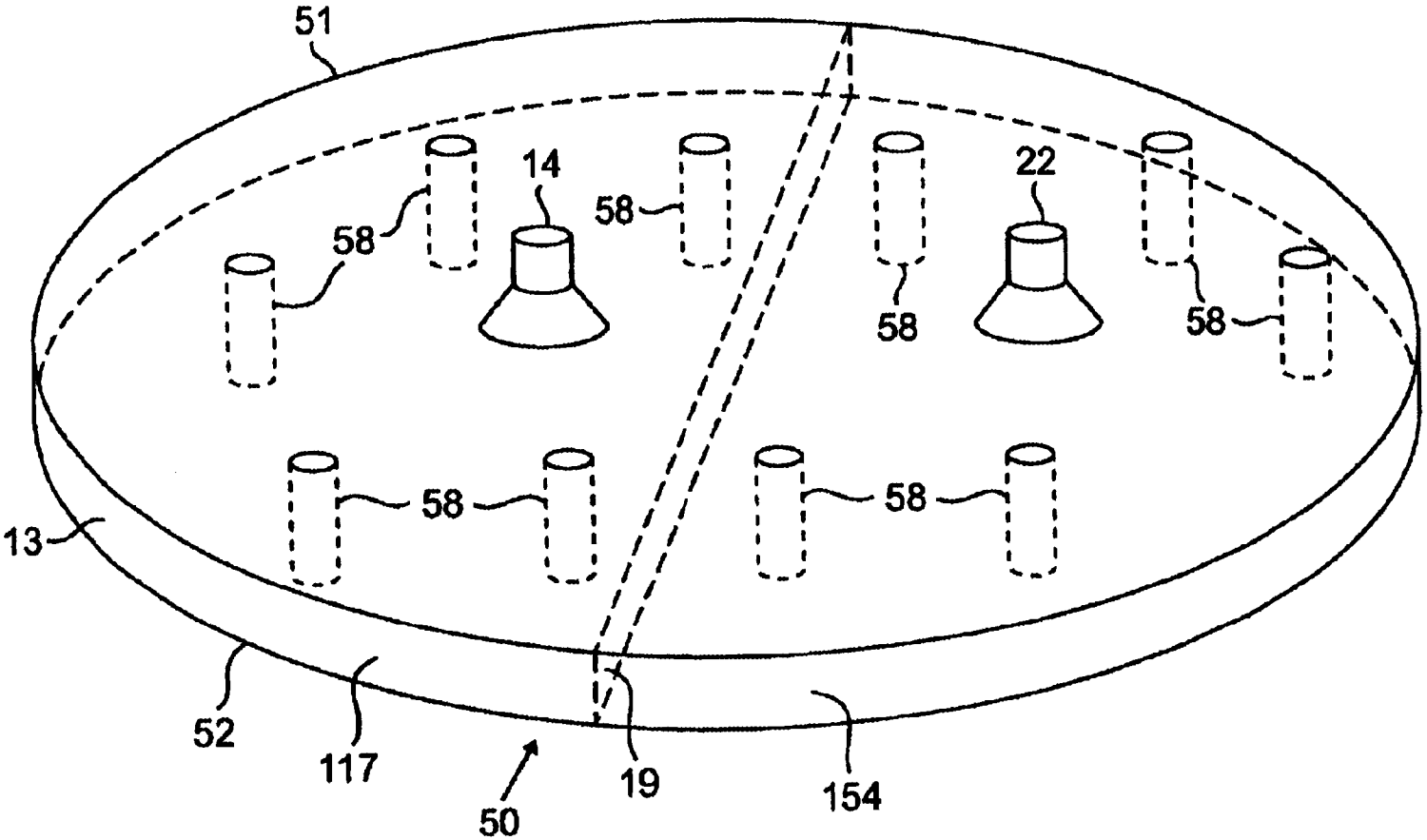
FIG. 5 is an isometric view of another embodiment of a transducer according to the invention, with the top optically transparent to show internal elements.

Referring now to FIG. 5, there are shown an isometric view of another embodiment of the invention. In FIG. 5, the vertical dimension is exaggerated to show features of the implementation. In the implementation of FIG. 5, the top 51 and bottom are spaced by one or more standoffs 58. The standoffs are a spacing structure that combines with the top 51 and bottom to define an interior volume of an acoustic enclosure similar to the interior volume of FIG. 4. Essentially the entire volume between top 51 and the bottom is an interior sound conducting region and the entire perimeter of the top 51 is a continuous opening, except as modified by optional baffles, such as baffle 19 that separates the left and right sides of the interior volume. Baffles will be explained in more detail below. Standoffs 58, greatly exaggerated in this view, have a small cross sectional area when viewed from the top, and therefore have a minimal effect on the sound waves in the interior sound conducting region. The acoustic transducer placement, shape, and dimensions of the top 51 of the acoustic enclosure are determined in such a manner that the lengths of the total direct acoustic paths (as defined above) between acoustic transducers 14 and 22 and the nearest ear of a user positioned near front 154 of the structure are substantially equal.

Figure 6A:
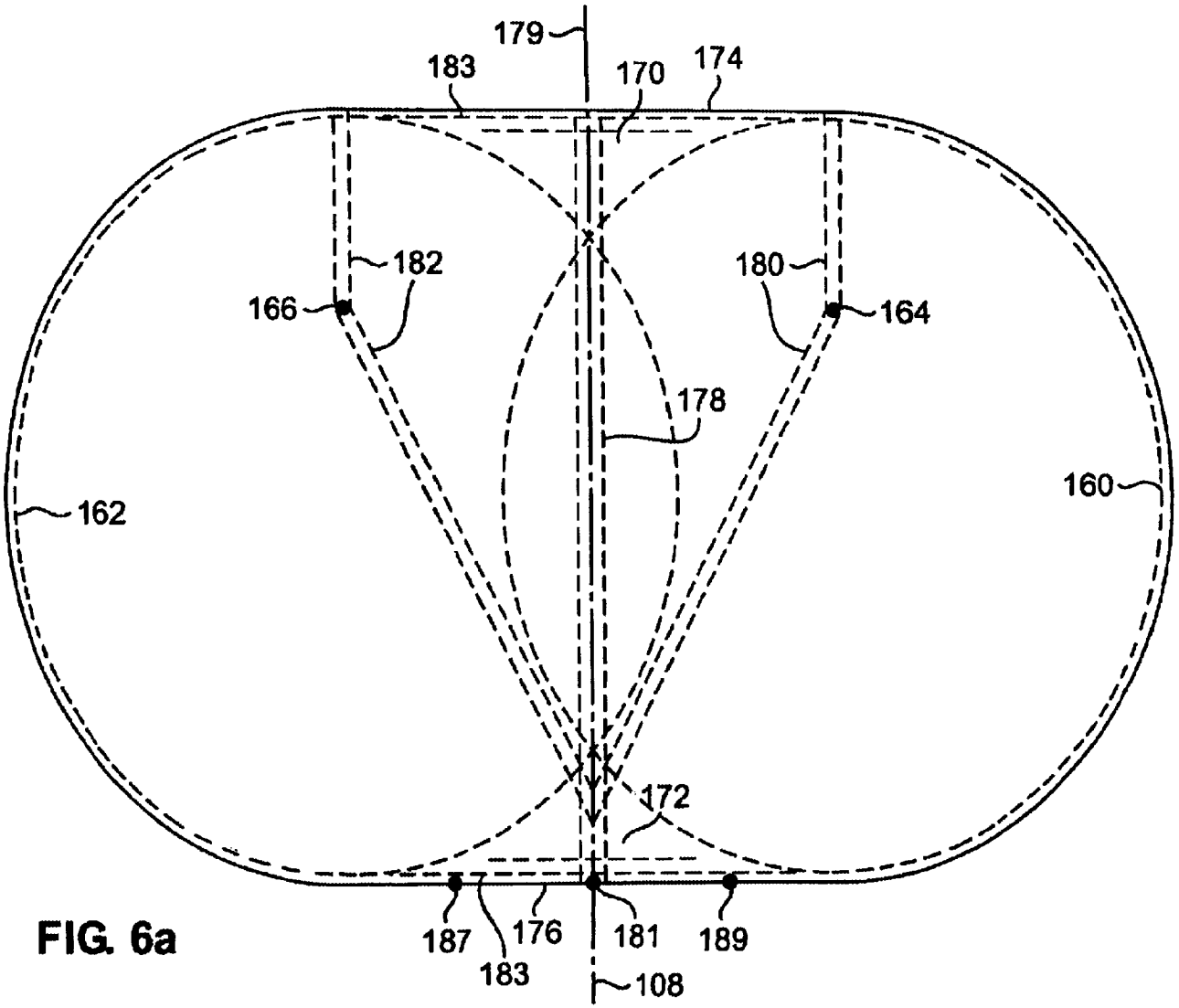
FIGS. 6*a* and 6*b* are top plan views of yet another embodiment of a transducer according to the invention, with the top optically transparent to show internal elements.
Figure 6B:
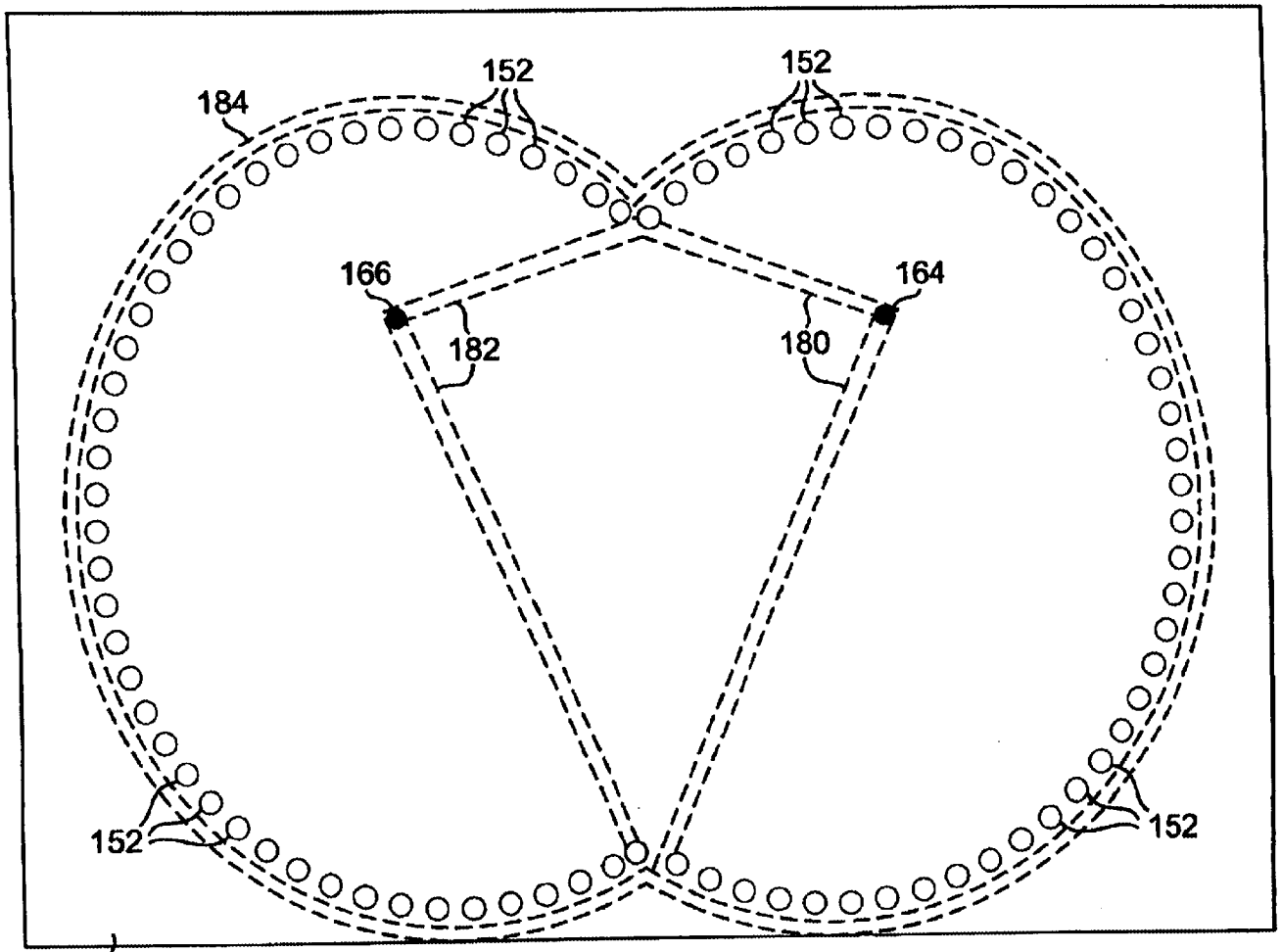

FIGS. 6*a* and 6*b* illustrate embodiments of the invention, and will be used to show how the arrangement of the outlet points may be determined. The embodiments of FIGS. 6*a* and 6*b* may use standoffs similar to the standoffs 58 of FIG. 5. The configuration (including the dimensions and shape of the top 51, the placement of the mounting points for the acoustic driver, and the shape and placement of any baffles) of an acoustic enclosure that results in equal lengths of total direct acoustic paths between an acoustic driver and the user's right ear passing through each point on the perimeter of the top can be described by an ellipse 160 with the mounting point for the acoustic driver placed on the ellipse focus 164 farthest from the listening point. Similarly, the configuration of an acoustic enclosure top that results in the total direct acoustic path between an acoustic transducer and the user's left ear passing through each point on the perimeter of the top can be described by an ellipse 162, with the acoustic transducer placed at the ellipse focus 166 farthest from the listening point. The formula for the ellipses is shown in the Appendix.

The method for applying the formula will be explained using the example shown in FIGS. 6*a* and 6*b*. The formulas in the Appendix describe the two ellipses, 160 and 162 (shown in dashed lines). The ellipse 160 represents points at which the distance of all the total direct acoustic paths from an acoustic transducer placed at an ellipse focus 164 to the user's right ear are equal. Similarly, the ellipse 162 represents points at which the distance of all the total direct acoustic paths from an acoustic transducer placed at an ellipse focus 166 to the user's left ear are equal. As stated in the Appendix, the origin for applying the formulas of the Appendix is the midpoint 181 between the projections 187 and 189 of the user's assumed ear positions on the plane of the top 51. A pattern of exit points for the top could then be described by the perimeter of the areas enclosed by one or both of the ellipses.

In the embodiment of FIG. 6*a*, the outlet points are the sides 13 (see FIG. 4) of an acoustic enclosure with a top shaped so as to coincide with areas that are enclosed by ellipse 160, ellipse 162, or both. A somewhat more practical acoustic enclosure top shape has been created by filling in the "notches" 170 and 172 with lines 174 and 176 tangent to the two ellipses. Sound waves reaching the user's nearest ear through points on the perimeter of the top which fall on the ellipses sum coherently at the user's ear. If desired, a baffle 178 may be placed along the centerline 108 extending from front to back to reflect sound waves radiated by an acoustic transducer on one side away from the farthest ear. One implementation, with a desired widest dimension of 34 inches and a longest front to back measurement of 24 inches can be described by the set of points in the Appendix.

A portion (defined by lines 174 and 176) of the perimeter of top 51 does not lie on one of the ellipses 160 and 162. It may be desirable to place baffles to minimize the sound radiation that passes through points not on the ellipses. For example, baffles could be placed on the portions 183 of the perimeter of the acoustic enclosure not lying on the ellipses, or baffles could be placed on lines 180 or 182 connecting the acoustic transducer with the portions of the perimeter of the top not lying on the one or the ellipses. The baffles reduce the sound radiated from portions of the perimeter for which the total direct acoustic lengths are not equal.

In the embodiment of FIG. 6*b*, the sides (not shown) of the top 51 are solid, with acoustic transducers positioned at ellipse foci 164 and 166 farthest from the user position. The outlet points are a series of openings, in this example discrete openings 152 of the top 51, arranged so that the discrete openings 152 fall on the ellipses 160 and 162 (not shown). Baffles 180 and 182 can be placed as was described in the discussion of FIG. 6*a*. An optional baffle 184 can be placed outside the discrete openings 152 to prevent reflections of the sound from being radiated from the discrete openings 152. Though the shape of the top 51 is shown as a rectangle, the shape can be arbitrary, preferably with the openings 152 lying inside the perimeter of the top 51. In other implementations, the discrete openings 152 may be replaced by one or more continuous openings.

Figure 7A:
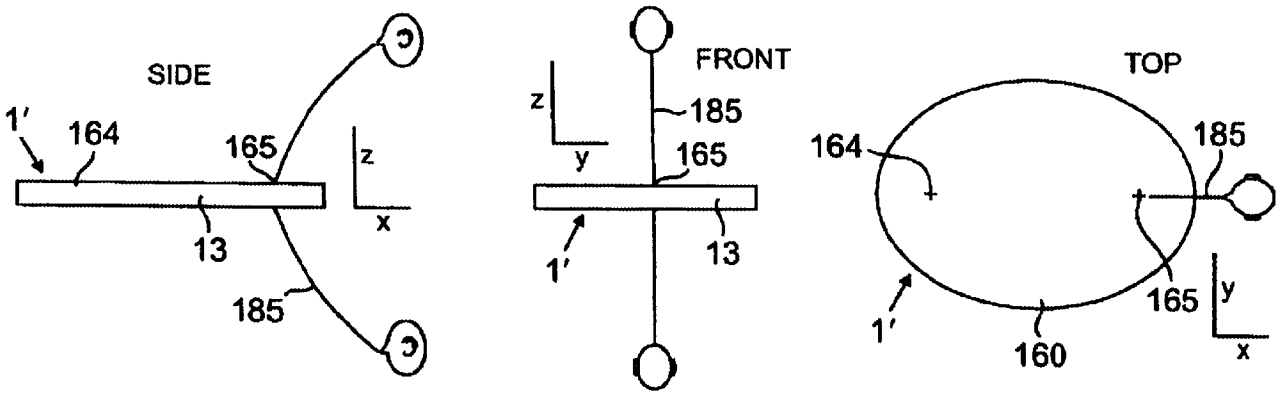
FIGS. 7*a* and 7*b* are side, top, and front plan views of a transducer according to the invention, illustrating another aspect of the invention.
Figure 7B:
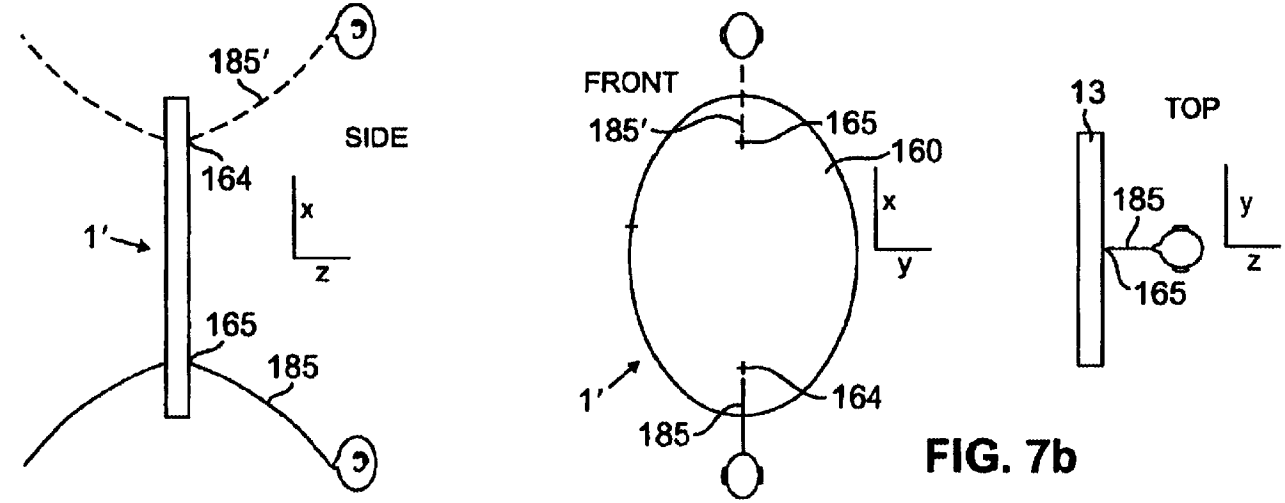

FIGS. 7*a* and 7*b* show side, front, and top plan views of a transducer, illustrating another aspect of the invention. Enclosure 1' has one elliptically shaped surface and a thickness, measured perpendicular to the ellipse, that is substantially less than the major axis and minor axis of the ellipse. The foci of the ellipse are at points 164 and 165. An acoustic transducer (not shown in this view) exchanges sound with the enclosure 1' at focus 164, passing through openings in the side 13' of the enclosure 1'. The points at which the total direct acoustic paths are equal lies on a hyperbola 185 that is described by the formula shown in the Appendix. FIGS. 7*a* and 7*b* show the transducer with the elliptically shaped surface in the horizontal and vertical planes, respectively. The x, y, and z-axes are defined in relation to the ellipse, as described in the Appendix. The ellipse is in the xy plane, with major axis of the ellipse extending along the x-axis and the minor axis of the ellipse extending along the y axis. The hyperbola 185 is in the xz plane. With the ellipse in the horizontal plane, as in FIG. 7*a*, the transducer could be mounted in or on a floor, ceiling, or in some intermediates point such as on a desk as described in FIGS. 1–6*b*, 8, and 9. In the implementation of FIG. 7*b*, if the acoustic transducer is placed as focus 165, the points at which total direct paths are equal are described by hyperbola 185', so the intended user position may be above the transducer. For simplicity, only one ellipse and one user position are shown in each view. An arrangement with two transducers and a user position at each ear, as in the other figures, could also be arranged, given the teachings of this disclosure. With some implementations, the ellipses may overlap, as in the implementations of FIGS. 5, 6*a*, and 6*b*.

By varying the parameters (the length of the major and minor axes) of the ellipse, the points at which the total direct paths are equal can be made to occur at a wide variety of points in space, and the transducer could be used in many different manners. Examples include mounting the acoustic enclosure on a wall, ceiling, or floor, to present a specific acoustic effect at a specific user location. In other implementations, the top may be non planar and the thickness non uniform.

Figure 8:
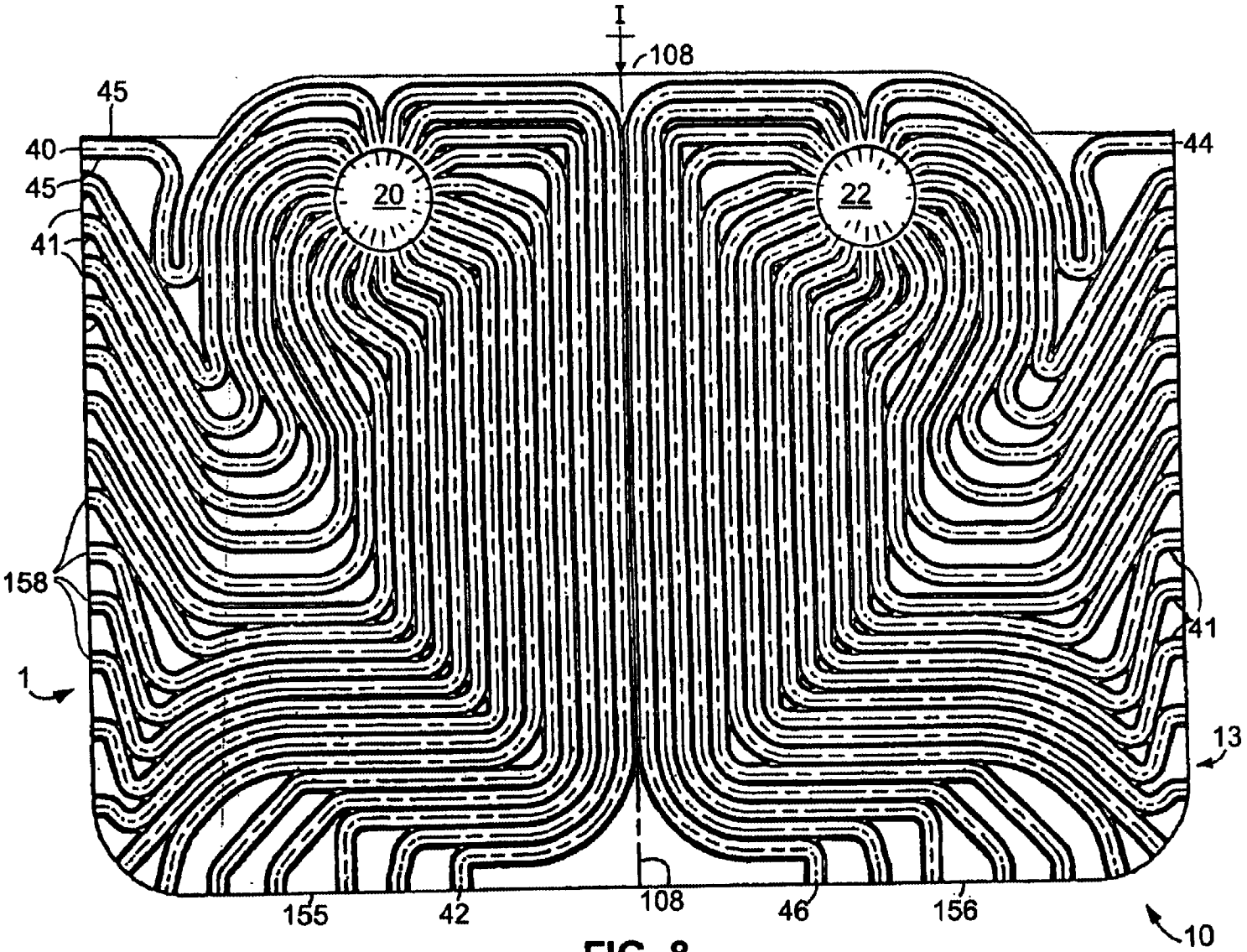
FIG. 8 is a top plan view the transducer of FIG. 1, with the top optically transparent to show internal elements.

FIG. 8 is a top plan view of another embodiment of the invention, with the top 51 optically transparent; in an actual implementation, the top may be optically transparent or opaque. Positioned in acoustic enclosure 1 are a plurality of discrete acoustic waveguides 41 for acoustically coupling acoustic transducers 20 and 22 with discrete outlet points. In the embodiment of FIG. 8, the sound conducting region is the combined interiors of the discrete acoustic waveguides. The total direct acoustic paths are the sum of the effective acoustic length of the discrete acoustic waveguides to a discrete outlet point such as points 158 on the side edge 13 of the acoustic enclosure, and the length of a straight line from discrete exit points such as points 158 to the user's position. The discrete acoustic waveguides are sized so that the total thickness is less than one inch, and so that effective lengths of the total direct acoustic paths are substantially equal. The waveguides 41 form an acoustic phased array and are arranged so that the acoustic path length from the acoustic transducers 20 and 22 to the user's position is substantially the same regardless of the waveguide traveled through. One way to provide a wide range of waveguide lengths is to place the acoustic transducers 20 and 22 at locations such that the longest waveguides 42 and 46 exit the perimeter of the acoustic enclosure at the points closest to the user and the shortest waveguides 40 and 44 exit the perimeter of the acoustic enclosure farthest from the user. The effective length of the acoustic path may be somewhat different than the physical length of the acoustic path. For example, there may be "end effects" that cause the effective acoustic length of the tube to be longer than its physical length, or it may be appropriate to slightly shorten the longer waveguides relative to the shorter waveguides to account for phase shifts that may occur. Additionally, cross sectional areas of the waveguides that exit the acoustic enclosure farthest from the user may be made slightly larger to provide amplitude attenuation compensation that may be desirable since the proportions of the total direct path lengths in the waveguide and in air differ from waveguide to waveguide. In this implementation, on the left side 155 there are twenty waveguides ranging in length from twenty inches to thirty-nine inches in one inch increments, and a twenty first of length thirty eight and one-half inches. The right side 156 is a mirror image, along centerline 108, of the left side.

One method for implementing the embodiment of FIG. 8 is to form or mold the partitions 45 that define the discrete acoustic waveguides 41 in the top 51 or bottom 52 of acoustic enclosure 1, and to join the bottom 52 or top 51 respectively in such a manner that the bottom or top forms an airtight seal with the partitions 45 of the discrete waveguides, thereby forming the waveguides, and so that the partitions 45 act as a spacing structure to space the top 51 to the bottom 52. Another implementation of the embodiment of FIG. 8 is to form the discrete acoustic waveguides 41 from flexible tubing of the appropriate length and to "sandwich" the tubing between the top 51 and the bottom 52 in such a manner that the ends of the several tubes are at the appropriate position on the perimeter of the acoustic enclosure.

Figure 9:
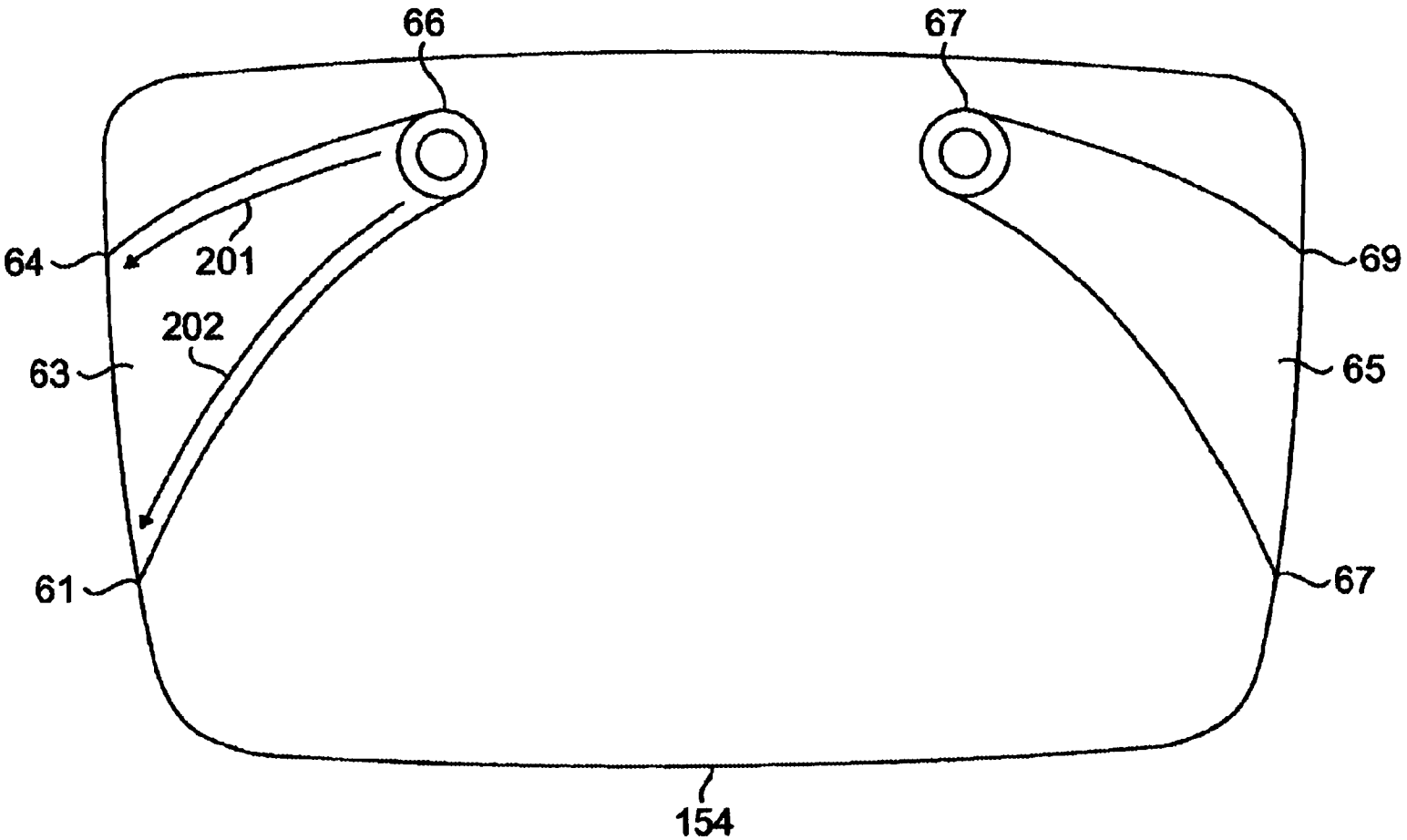
FIG. 9 is a top plan view the transducer of FIG. 1, with the top optically transparent to show internal elements.

FIG. 9 shows a top view, with top 51 made optically transparent, of another implementation of the invention. Interior sound conducting regions 63 and 65 are shaped so that the paths nearer the back of the structure (such as path 201) are shorter than the paths nearer the front of the structure (such as path 202), so that the total direct acoustic paths from acoustic transducer 66 to the user positioned near the front 154, passing through the two ends 61 and 64 of an opening, and points in between, are substantially equal.

In all of the embodiments, the invention may be practiced even if there is some variance in the length of total direct acoustic paths. For example, the total direct acoustic path lengths may vary by a few inches to make the acoustic enclosure more practical or more manufacturable, or in implementations such as some of the implementations of the embodiment of FIG. 6*a*, the total direct acoustic path lengths of a small portion of the perimeter may not be equal to the total direct acoustic path lengths passing through the other portions of the perimeter.

In the embodiments of FIGS. 4, 5, 6*a*, 6*b*, 7*a*, 7*b*, 8, and 9, the top 51 (identified in FIGS. 4 and 5) need not have a planar outer surface. Positioning the outlet points 4, whether in the form of continuous openings (as in FIGS. 4, 5, 6*a*, 7*a*, 7*b*, and 9) or in the form of discrete points (as in FIGS. 6*b* and 8) so that they are in a common plane cases design and calculation of total direct acoustic path lengths. However, the outside of the top may be non planar for cosmetic or functional reasons.

In some of implementations of the embodiments of FIGS. 1–9, the acoustic enclosure 1 conforms to a planar surface, so that it can be conveniently placed or mounted on a surface such as a desktop, floor, wall, or ceiling, and so that it can be conveniently moved and placed or mounted on another surface. In other implementations, the acoustic enclosure may be integrated into the planar surface. For example, a deskpad implementation may be built into a desktop or tabletop, so that the bottom 52 is a part of the plane of the desktop; or a wall, floor, or ceiling implementation may be built so that the bottom if integrated into, or a part of, the wall, floor, or ceiling. In other implementations, such as the implementations of FIGS. 6*a* and 6*b*, the top 51 could be integrated into a desktop, wall, floor, or ceiling.

It is evident that those skilled in the art may now make numerous uses and modifications of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

APPENDIX

Ellipse Formula

The formula for the ellipse describing the points in the plane of the acoustic enclosure top through which the path length from the transducer to the user's right ear are equal is:

$$x_r = a + \frac{-a + \sqrt{C^2 + F^2}\sqrt{C^2 + D^2}\sqrt{(2y_rF - F^2 + d^2)(2y_rD - D^2 + d^2)} + (C^2 + FD)((-F)D + y_r(F + D) + d^2}{(C(F - D)^2)} \quad \text{(Equation 1)}$$

where:

$x_r$ is the x value of the points of the ellipse corresponding to the right ear;

$y_r$ is the y value of the points of the ellipse corresponding to the right ear;

the origin ($X_r$=0, $y_r$=0) is the projection on the plane of the acoustic enclosure of the point directly between the user's ears, with the x axis parallel to a line connecting the user's ears;

a is the offset of the ear from the origin (i.e. one half the distance between the ears);

b is the desired width of the pad;

c is the desired depth (front to back) of the pad;

d is the perpendicular distance from the ear to the plane of the top of the acoustic enclosure;

e is the y coordinate of the nearest edge of the pad (=0 if the ears are directly over the edge, <0 if the ears are over the pad, >0 if the ears are behind the edge of the pad $$e \le y_r \le (e+c)$$

$$A = a + \frac{b}{2}$$

$$B = e + c$$

$$C = A + \sqrt{d^2 + A^2}$$

$$D = e - \sqrt{d^2 + B^2}$$

$$F = B + \sqrt{d^2 + e^2}$$

The formula for the ellipse describing the points in the plane of the acoustic enclosure top through which the path length from the transducer to the user's left ear are equal is a mirror image about a centerline, running front to back.

$$x_l = -a - \frac{-a + \sqrt{C^2 + F^2}\sqrt{C^2 + D^2}\sqrt{(2y_l F - F^2 + d^2)(2y_r D - D^2 + d^2)} + (C^2 + FD)((-F)D + y_r(F + D) + d^2}{(C(F - D)^2)}$$

(Equation 2)

where:

$x_l$ is the x value of the points of the ellipse corresponding to the left ear;

$y_l$ is the y value of the points of the ellipse corresponding to the left ear; and the origin ($x_r$=0, $y_r$=0) is the projection on the plane of the acoustic enclosure of the point directly between the user's ears, and the x axis is parallel to a line connecting the user's ears;

$e \leqq y_l \leqq (e+c)$ and where the other variables are as defined in Equation 1.

The y and x coordinates of the midpoint of the acoustic driver mounting point are:

$$y_t = \frac{c + \sqrt{(e-c)^2 + d^2} - \sqrt{(e+d)^2}}{2}$$

$$x = y - \left(-\sqrt{(p+g)^2} + J\sqrt{\frac{\left(\frac{\sqrt{G^2+H^2}}{2}\right)^2}{1+C^2} + \left(\left(\frac{1}{J}\right)\left(a + \sqrt{\frac{\frac{\sqrt{G^2+H^2}}{2}}{1+J^2}}\right)\right)}\right)$$

(Equation 3)

where $G = e + \sqrt{(e+d)^2}$ $$H = \frac{b}{2} + \left(\sqrt{\left(\frac{b}{2} - a\right) + d^2}\right) + a \text{ and}$$

$$J = \frac{G}{H}$$

where $x_t$ and $y_t$ are the coordinates of the transducer location and the other variables are defined as in Equation 1.

A shape for a top of an acoustic enclosure determined by Equations 1, 2, and 3 and the teachings of FIG. 3*a* and the corresponding sections of the disclosure or exit points in the top according to the teachings for FIG. 3*b* and the corresponding portion of the disclosure can be described by the following points, assuming:

the pad is placed so that the nearest edge of the pad is at the origin (e=0)

the user's ears are assumed to be six inches apart (a=3.00)

the user's ears are assumed to be 18 inches above the plane of the top of the acoustic enclosure (d=18.00)

the desired widest dimension of the top is 34 inches (b=34.00)

the desired longest front to back measurement is 24 inches (c=24.00)

| Transducer location: 8.20, ±18.00 | |
|---|---|
| x | y |
| ±5.60 | 0.00 |
| ±9.87 | 1.00 |

-continued

| Transducer location: 8.20, ±18.00 | |
|---|---|
| x | y |
| ±11.55 | 2.00 |
| ±12.76 | 3.00 |
| ±13.71 | 4.00 |
| ±14.49 | 5.00 |
| ±15.12 | 6.00 |
| ±15.65 | 7.00 |
| ±16.07 | 8.00 |
| ±16.41 | 9.00 |

-continued

| Transducer location: 8.20, ±18.00 | |
|---|---|
| x | y |
| ±16.67 | 10.00 |
| ±16.86 | 11.00 |
| ±16.96 | 12.00 |
| ±17.00 | 13.00 |
| ±16.96 | 14.00 |
| ±16.85 | 15.00 |
| ±16.65 | 16.00 |

-continued

| Transducer location: 8.20, ±18.00 | |
|---|---|
| x | y |
| ±16.37 | 17.00 |
| ±15.99 | 18.00 |
| ±15.50 | 19.00 |
| ±14.87 | 20.00 |
| ±14.06 | 21.00 |
| ±12.99 | 22.00 |
| ±11.46 | 23.00 |
| ±7.33 | 24.00 |

with a straight line connecting ±5.60, 0.00 and a straight line connecting ±7.33, 24.00

Hyperbola Formula

The formula for the hyperbola (such as hyperbola 185 of FIGS. 7*a* and 7*b*) describing the points to which the total direct acoustic paths from an acoustic driver placed at one focus of an ellipse, as described in the disclosure is:

$$\frac{x^2}{\gamma^2} - \frac{z^2}{\beta^2} = 1$$

where:

α is the length of the semi-major axis along the x-axis of the ellipse

β is the length of the semi-minor axis along the y-axis of the ellipse $$\gamma = \sqrt{\alpha^2 - \beta^2}$$

the origin (point 0,0,0) is the intersection of the major and minor axes of the ellipse

What is claimed is:

1. An electrocoustical transducer comprising:

a first rigid sheet having a shape and a boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer having a vibratable diaphragm constructed and arranged for exchanging first sound waves with said acoustic enclosure with only one side of said diaphragm;

said enclosure having a first plurality of outlet points, whereby said first sound waves pass through said first plurality of outlet points, wherein said second rigid sheet is constructed and arranged to conform to a planar surface.

2. An electroacoustical transducer in accordance with claim 1, wherein said thickness is no greater than one inch.

3. An electroacoustical transducer comprising, a first rigid sheet having a shape and a boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer for exchanging first sound waves with said acoustic enclosure;

said enclosure having a first plurality of outlet points, whereby said first sound waves pass through said first plurality of outlet points, wherein said second rigid sheet is constructed and arranged to conform to a planar surface, wherein a ratio of a smaller of said width and said depth to said thickness is at least 20:1.

4. An electroacoustical transducer comprising, a first rigid sheet having a shape and a boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer having a vibratable diaphragm constructed and arranged for exchanging first sound waves with said acoustic enclosure with only one side of said diaphragm;

said enclosure having a first plurality of outlet points, whereby said first sound waves pass through said first plurality of outlet points, wherein said second rigid sheet is constructed and arranged to conform to a planar surface, said enclosure having a first plurality of outlet points, whereby said first sound waves pass through said first plurality of outlet points, wherein said second rigid sheet is constructed and arranged to conform to a planar surface, each of said first plurality of outlet points having an associated total direct acoustic path length consisting of an effective internal acoustic length in said acoustic enclosure between said acoustic transducer and said each outlet point and an external acoustic length between said each outlet point and a first predetermined region in space, wherein said transducer is constructed and arranged so that said total direct acoustic path lengths associated with said first plurality of outlet points are substantially equal.

5. An electroacoustical transducer in accordance with claim 4, wherein said first predetermined region is space is a region proximate the predicted position of a first ear of a user of said transducer.

6. An electroacoustical transducer in accordance with claim 4, wherein said first plurality of outlet points are discrete points in said acoustic enclosure, said transducer further comprising discrete acoustic waveguides acoustically coupling said first acoustic transducer and said discrete points.

7. An electroacoustical transducer in accordance with claim 4, wherein said first plurality of outlet points are points in a first continuous opening, said transducer further comprising a first duct acoustically coupling said first acoustic transducer and said first continuous opening.

8. An electroacoustical transducer in accordance with claim 4, wherein said first plurality of outlet points are points in a continuous opening in said side edge acoustically coupled to said first acoustic transducer.

9. An electroacoustical transducer in accordance with claim 8, wherein a portion of a perimeter of said top is shaped as a section of an ellipse.

10. An electroacoustical transducer in accordance with claim 4, wherein said first plurality of outlet points are in said top and wherein said first plurality of outlet points are positioned in the form of a section of an ellipse.

11. An electroacoustical transducer in accordance with claim 10, wherein said each of said first plurality of outlet points is a discrete opening in said top.

12. An electroacoustical transducer in accordance with claim 1, wherein said first plurality of outlet points is points in a first continuous opening in said side edge.

13. An electroacoustical transducer in accordance with claim 12, further comprising a baffle structure effecting said sound waves that pass through said first continuous opening.

14. An electroacoustical transducer comprising, a first rigid sheet having a shape and a boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer for exchanging first sound waves with said acoustic enclosure;

said enclosure having a first plurality of outlet points, whereby said first sound waves pass through said first plurality of outlet points, wherein said second rigid sheet is constructed and arranged to conform to a planar surface, wherein said first plurality of outlet points is points in a first continuous opening in said side edge, further comprising a baffle structure effecting said sound waves that pass through said first continuous opening, each of said first plurality of outlet points having an associated total direct acoustic path length consisting of an effective internal acoustic length in said acoustic enclosure between said acoustic transducer and said each outlet point and an external acoustic length between said each outlet point and a first predetermined region in space, wherein said baffle structure is configured and dimensioned so that said total direct acoustic path lengths associated with said first plurality of outlet points are substantially equal.

15. An electroacoustical transducer in accordance with claim 13, further comprising a second continuous opening in said edge, wherein a first portion of said first plurality of openings are points in said first continuous opening and a second portion of said first plurality of outlet points are points in said second continuous opening, wherein said baffle structure effects said sound waves that pass through said first continuous opening and said second continuous opening.

16. An electroacoustical transducer in accordance with claim 1, further comprising:

a second acoustic transducer for exchanging second sound waves with said acoustic enclosure; and a second plurality of outlet points in said enclosure, whereby said second sound waves pass through said acoustic enclosure and through said second plurality of outlet points.

17. A loudspeaker comprising, a first rigid sheet having a shape and a boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer for exchanging first sound waves with said acoustic enclosure;

said enclosure having a first plurality of outlet points, whereby said first sound waves pass through said first plurality of outlet points, wherein said second rigid sheet is constructed and arranged to conform to a planar surface, a second acoustic transducer for exchanging second sound waves with said acoustic enclosure; and a second plurality of outlet points in said enclosure, whereby said second sound waves pass through said acoustic enclosure and through said second plurality of outlet points, each of said second plurality of outlet points having an associated total direct acoustic path length consisting of an effective internal acoustic length in said acoustic enclosure between said acoustic transducer and said each of said second plurality of outlet points and an external acoustic length between said each of said second plurality of outlet points and a second predetermined region in space, wherein said transducer is constructed and arranged so that said total direct acoustic path lengths associated with said second plurality of outlet points are substantially equal.

18. An electroacoustical transducer in accordance with claim 17, wherein said second predetermined region is space is a region proximate the predicted position of a second ear of said user.

19. An electroacoustical transducer in accordance with claim 17, wherein said second plurality of outlet points are second discrete points in said acoustic enclosure, said loudspeaker further comprising second discrete acoustic waveguides acoustically coupling said second acoustic transducer and said second discrete outlet points, said second discrete acoustic waveguides dimensioned so that said total direct acoustic path lengths associated with said second plurality of outlet points are substantially equal.

20. An electroacoustical transducer in accordance with claim 16, wherein said first acoustic driver receives an audio signal representing a first stereo channel and wherein said second acoustic driver receives an audio signal representing a second stereo channel.

21. An electroacoustical transducer comprising:

an acoustic enclosure comprising a first rigid sheet having a shape and boundary and further having a width and a depth;

a second rigid sheet; and a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth;

a first acoustic transducer having a vibratable diaphragm constructed and arranged for exchanging first sound waves with said acoustic enclosure with only one side of said diaphragm; and a first plurality of outlet points in said acoustic enclosure, whereby said first sound waves pass through said first plurality of outlet points, wherein a first portion of said first plurality of outlet points are in a first continuous opening in said side edge of said acoustic enclosure, and wherein a second portion of said first plurality of outlet points are in a second continuous opening in said side edge of said acoustic enclosure;

a second acoustic transducer having a vibratable diaphragm constructed and arranged for exchanging second sound waves with said acoustic enclosure with only one side of said diaphragm; and a second plurality of outlet points in said enclosure, whereby said second sound waves pass through said second plurality of outlet points, wherein a first portion of said second plurality of outlet points are points in a third continuous opening in said side edge of said acoustic enclosure, and wherein a second portion of said second plurality of outlet points are points in a fourth continuous opening in said side edge of said acoustic enclosure.

22. An electroacoustical transducer in accordance with claim 21, wherein said first acoustic transducer receives an audio signal representing a first stereo channel and wherein said second acoustic transducer receives an audio signal representing a second stereo channel.

23. An electroacoustical transducer comprising, wherein an acoustic enclosure comprising a first rigid sheet having a shape and boundary and further having a width and a depth;

a second rigid sheet; and a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth;

a first acoustic transducer for exchanging first sound waves with said acoustic enclosure; and a first plurality of outlet points in said acoustic enclosure, whereby said first sound waves pass through said first plurality of outlet points, wherein a first portion of said first plurality of outlet points are in a first continuous opening in said side edge of said acoustic enclosure, and wherein a second portion of said first plurality of outlet points are in a second continuous opening in said side edge of said acoustic enclosure;

a second acoustic transducer for exchanging second sound waves with said acoustic enclosure; and a second plurality of outlet points in said enclosure, whereby said second sound waves pass through said second plurality of outlet points, wherein a first portion of said second plurality of outlet points are points in a third continuous opening in said side edge of said acoustic enclosure, and wherein a second portion of said second plurality of outlet points are points in a fourth continuous opening in said side edge of said acoustic enclosure, each of said first plurality of outlet points has an associated total direct acoustic path length consisting of an effective internal acoustic length in said acoustic enclosure between said acoustic driver and said each outlet point and an external acoustic length between said each outlet point and a first predetermined region in space, wherein said transducer is constructed and arranged so that said total direct acoustic path lengths associated with said first plurality of outlet points are substantially equal; and wherein each of said second plurality of outlet points has an associated total direct acoustic path length consisting of an effective internal acoustic length in said acoustic enclosure between said acoustic driver and said each outlet point and an external acoustic length between said each outlet point and a second predetermined region in space, wherein said transducer is constructed and arranged so that said total direct acoustic path lengths associated with said second plurality of outlet points are substantially equal.

24. An electroacoustical transducer in accordance with claim 23, wherein said first predetermined region in space and said second predetermined region in space are coincident.

25. An electroacoustical transducer in accordance with claim 23, wherein said first predetermined region is space is a region proximate the predicted position of first ear of a user of said loudspeaker and said second predetermined region is space is a region proximate the predicted position of a second ear of said user of said loudspeaker.

26. An electroacoustical transducer comprising:

an acoustic enclosure;

an acoustic transducer, for exchanging sound waves with said acoustic enclosure;

a plurality of outlet points from said enclosure through which said sound waves pass, wherein said outlet points are in a common plane and are arranged in an elliptical pattern.

27. An electroacoustical transducer in accordance with claim 26, wherein said plurality of outlet points are points in a continuous opening.

28. An electroacoustical transducer in accordance with claim 26, wherein said plurality of outlet points are discrete points.

29. An electroacoustical transducer comprising:

a first rigid sheet having a shape and boundary and further having a width and a depth;

a second rigid sheet;

a spacing structure for spacing said first rigid sheet from said second rigid sheet to define an acoustic enclosure, said acoustic enclosure having a top, a bottom and a side edge, wherein said top includes said first rigid sheet and said bottom includes said second rigid sheet, said acoustic enclosure having a thickness between said top and said bottom, wherein said thickness is substantially less than said width and said depth; and a first acoustic transducer for exchanging first sound waves with said acoustic enclosure;

said enclosure having a first plurality of outlet points, whereby said first sound waves pass through said first plurality of outlet points, each of said first plurality of outlet points having an associated total direct acoustic path length consisting of an effective internal acoustic length in said acoustic enclosure between said wherein said first predetermined region is space is a region proximate the predicted position of a first ear of a user acoustic transducer and said each outlet point and an external acoustic length between said each outlet point and a first predetermined region in space, wherein said transducer is constructed and arranged so that said total direct acoustic path lengths associated with said first plurality of outlet points are substantially equal.

30. An electroacoustical transducer in accordance with claim 29, wherein said first predetermined region is space is a region proximate the predicted position of a first ear of a user.

31. An electroacoustical transducer loudspeaker in accordance with claim 29, wherein said first plurality of outlet points are discrete points in said acoustic enclosure, said transducer further comprising discrete acoustic waveguides acoustically coupling said first acoustic transducer and said discrete points.

32. An electroacoustical transducer in accordance with claim 29, wherein said first plurality of outlet points are points in a first continuous opening, said transducer further comprising a first duct acoustically coupling said first acoustic transducer and said first continuous opening.

33. An electroacoustical transducer in accordance with claim 29, wherein said spacing structure, said first sheet, and said second sheet are constructed and arranged so that said acoustic enclosure has a side edge, and wherein said first plurality of outlet points are points in a continuous opening in said side edge acoustically coupled to said first acoustic transducer.

34. An electroacoustical transducer in accordance with claim 33, wherein a portion of a perimeter of said top is shaped as a section of an ellipse.

35. An electroacoustical transducer in accordance with claim 29, wherein said first plurality of outlet points are in said top and are positioned in the form of a section of an ellipse.

36. An electroacoustical transducer in accordance with claim 35, wherein each of said first plurality of outlet points is a discrete opening in said top.

37. A loudspeaker in accordance with claim 36, wherein a one of said first sheet and said second sheet is a portion of one of a desktop, table top, wall, wall fixture, ceiling, ceiling fixture, floor, or floor fixture.

* * * * *